US006438342B2

(12) United States Patent
Hatano

(10) Patent No.: US 6,438,342 B2
(45) Date of Patent: Aug. 20, 2002

(54) INK BOTTLE SET UP UNIT FOR A PRINTING MACHINE

(75) Inventor: Shinya Hatano, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/782,222

(22) Filed: Feb. 14, 2001

(30) Foreign Application Priority Data

Feb. 22, 2000 (JP) ..... 2000-044893

(51) Int. Cl.[7] ..... G03G 15/00

(52) U.S. Cl. ..... 399/117; 222/DIG. 1; 399/120; 399/262

(58) Field of Search ..... 399/102, 107, 399/108, 111, 116, 117, 119, 120, 252, 262; 222/DIG. 1

(56) References Cited

U.S. PATENT DOCUMENTS 6,018,637 A * 1/2000 Huss et al. ..... 399/102

FOREIGN PATENT DOCUMENTS

EP 0 712 733 5/1996

* cited by examiner

*Primary Examiner*—Sophia S. Chen
*Assistant Examiner*—Hoan Tran
(74) *Attorney, Agent, or Firm*—Nath & Asspcoates PLLC; Gary M. Nath; Marvin C. Berkowitz

(57) ABSTRACT

A printing machine is provided which includes a body 1 having an opening 5, a drum support member 2 located in the body and having a head section 9 formed with an ink receptor port 8, and a turn table 11 mounted on the drum support member 2 for rotating movement and having a bottle guide to receive an ink bottle. The turn table 11 is freely rotatable between a bottle exchange position to allow an ink bottle 12 to be inserted into the bottle guide 14 through the opening 5 and a bottle receiving position to allow the ink bottle 12 set up in the bottle guide 14 to be received in an inner space of the opening 5.

5 Claims, 10 Drawing Sheets

INK BOTTLE SET UP UNIT FOR A PRINTING MACHINE

BACKGROUND OF THE INVENTION

The present invention relates to a printing machine having drums and, more particularly, to a printing machine having an ink bottle set-up unit to allow an ink bottle to be settled externally to the drum.

It has heretofore been proposed to use a stencil printing machine as a printing apparatus, wherein a stencil sheet is wound around a drum on the basis of image data, and a sheet of print paper is moved while it is urged toward the rotating drum to allow the image of an ink to be directly transferred to the print paper or, in an alternative way, a transfer drum is urged toward the rotating drum and is rotated such that an ink image is first transferred to the transfer drum and subsequently a sheet of print paper is urged toward the rotating transfer drum to transfer the ink image to the print paper. In such a stencil printing machine, it is a usual practice to have the printing machine equipped with an ink bottle set-up unit which serves as a source of an ink to supply the ink from an inner side of the drum. When, in this event, the drum is large in size and has an excessive space therein, the ink bottle set-up unit can be incorporated in the drum. When, however, the drum is small in size or when the drum is large in size but does not have an excessive space inside, the ink bottle set-up unit is installed outside the drum.

FIGS. 1 to 3 show a conventional stencil printing machine, which is investigated by the present inventor, of the type having an ink bottle set-up unit which is installed outside a drum. In FIG. 1, a body 100 of the printing machine incorporates therein a drum 102 supported by a drum support member 101. An outer periphery of the body 100 is covered with a body case 103, a part of which is formed with an opening 104. The drum support member 101 is freely moveable together with the drum 102 into or out from the body 100. When the drum 102 is held inside the body 100, an ink bottle set-up unit 105 is located in a space between the side periphery of the drum 102 and the opening 104.

The ink bottle set-up unit 105 is fixedly supported on the drum support member 101 and includes a head section 106 having an ink receptor port (not shown), and a cylindrical bottle guide 108 fixed to the drum support member 101 and having a bottle set-up chamber (which bears no reference numeral) to receive an ink bottle 107. The ink bottle 107 that has been inserted into the bottle set-up chamber (not shown) of the bottle guide 108 is freely moveable by actuating an actuating lever 109 (see FIGS. 2 and 3) between a bottle coupling position to allow an ink discharge spout (not shown) of the ink bottle 107 to be coupled to the ink receptor port (not shown) and a bottle uncoupling position to allow the ink discharge spout of the ink bottle 107 to be separated from the ink receptor port. The ink bottle 107 is configured to have a cylindrical shape, which lies sideward and close to the drum 102.

With such as structure, in order to replace the ink bottle 107 of the ink bottle set-up unit 105 with new one, it is required that the drum 102 is first pulled out together with the drum support member 101 from the body 100 of the printing machine as viewed in FIG. 1 and, secondly, the ink bottle 107 is moved from the bottle coupling position to the bottle uncoupling position by operating the actuating lever 109 as viewed in FIG. 2. Subsequently, the ink bottle 107 is removed from the bottle guide 108. Next, a new ink bottle 107 is inserted into the bottle set-up chamber (not shown) of the bottle guide 108 and the actuating lever 109 is operated such that the ink bottle 107 is moved from the bottle uncoupling position to the bottle coupling position. Finally, the drum support member 101 and the drum 102 are returned to the inside of the body 100, thereby completing a bottle replacement cycle.

SUMMARY OF THE INVENTION

In the conventional printing machine, however, it is required that the ink bottle 107 is replaced with new one by pulling out or inserting the heavy drum relative to the body 100 of the printing machine, causing a troublesome replacement work. Here, it is considered that the bottle set-up chamber (not shown) of the bottle guide 108 is designed to be aligned, to allow the ink bottle 107 to be inserted into or to be pulled out from the bottle set-up chamber, in the same direction (viz., on a concentric longitudinal axis with the drum 102) as that of the drum 102 to be pulled out or inserted into the body of the printing machine. When the ink bottle 107 is located in such a state relative to the drum 102, the printing machine is largely sized.

It is therefore an object of the present invention to provide a printing machine which is compact in structure and which is easy for replacement of an ink bottle.

According to one aspect of the present invention, there is provided a printing machine which comprises a body having a moveable drum support member carrying thereon a drum, and an opening to allow the drum support member and the drum to be inserted into or pulled out from the body, and an ink bottle set-up unit located in a space between the opening of the body and the drum located on the drum support member. The ink bottle set-up unit includes a turn table rotatably mounted on the drum support member, and a bottle guide located on the turn table and having a bottle set-up chamber to receive an ink bottle. The turn table is freely rotatable between a bottle exchange position in which the ink bottle is allowed to be inserted into the bottle set-up chamber through the opening of the body, and a bottle receiving position in which the ink bottle set-up in the bottle set-up chamber is received in the space.

According to another aspect of the present invention, there is provided a printing machine which comprises a body having an opening, a drum support member carrying a drum thereon and moveably supported in the body for sliding movement through the opening between a printing position in which the drum is held inside the body and an inoperative position in which the drum is held outside the body, and an ink bottle set-up unit moveably supported on the drum support member. The ink bottle set-up unit includes a turn table rotatably mounted on the drum support member, a bottle guide supported on the turn table and having a bottle set-up chamber to receive an ink bottle, and ink bottle coupling means for enabling the turn table to move between a bottle exchange position in which the ink bottle is allowed to be inserted into the bottle set-up chamber, and a bottle receiving position in which the ink bottle is located in a set-up position to allow an ink to be supplied to the drum for printing.

Other aspect and advantages of the invention will become more apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings, in which.

DETAILED DESCRIPTION OF THE PREFERRED EMBODIMENTS

Figure 1:
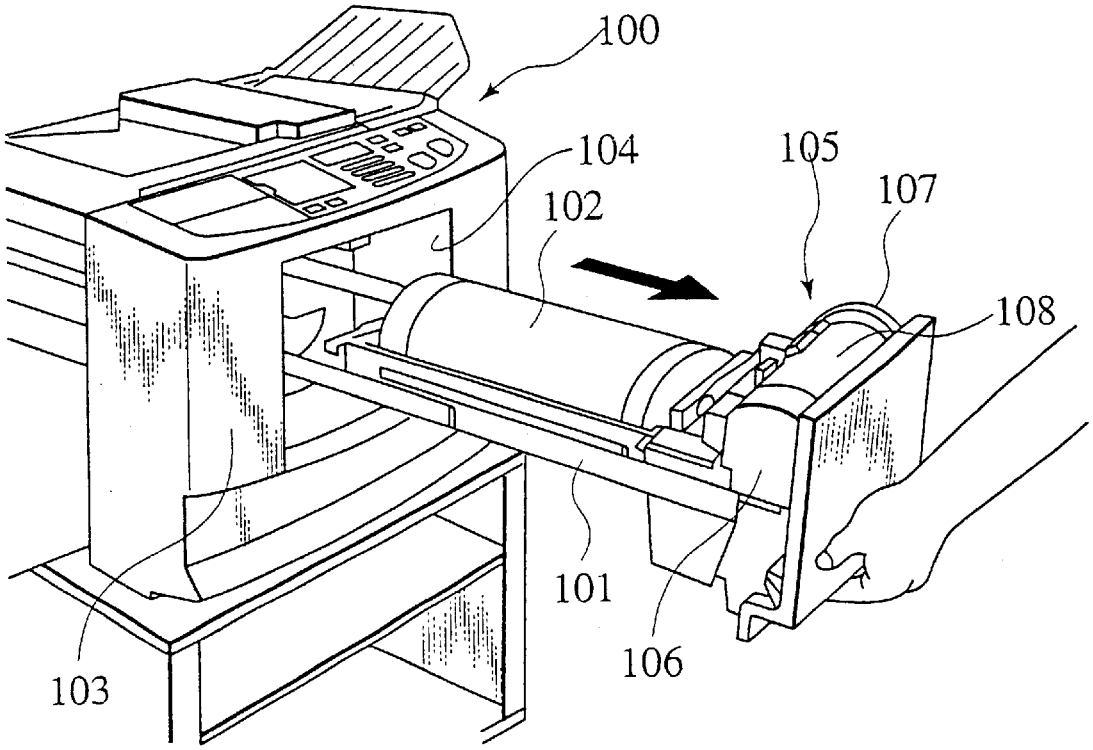
FIG.1 (PRIOR ART)
FIG. 1 is a perspective view of a conventional stencil printing machine equipped with an ink bottle set-up unit.
Figure 2:
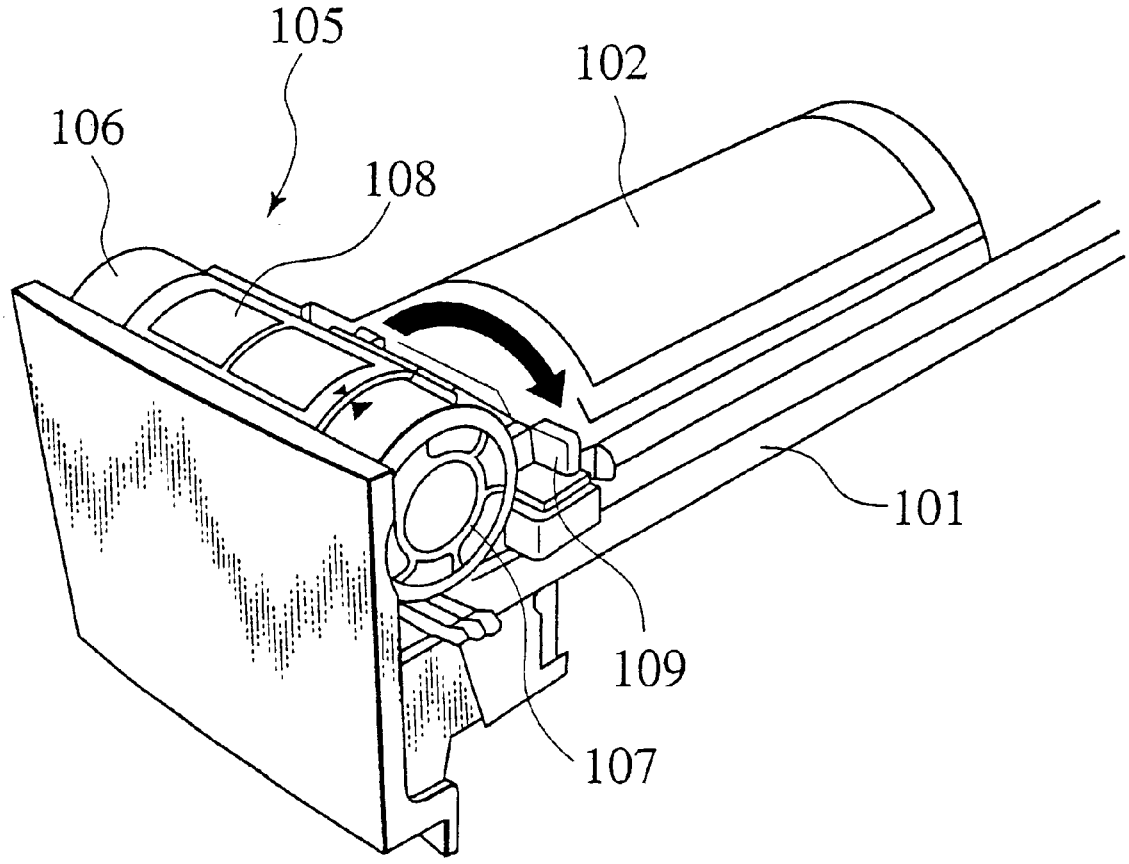
FIG.2 (PRIOR ART)
FIG. 2 is a perspective view of the printing machine of FIG. 1, showing the ink bottle set-up unit located in a retracted position with the drum.
Figure 3:
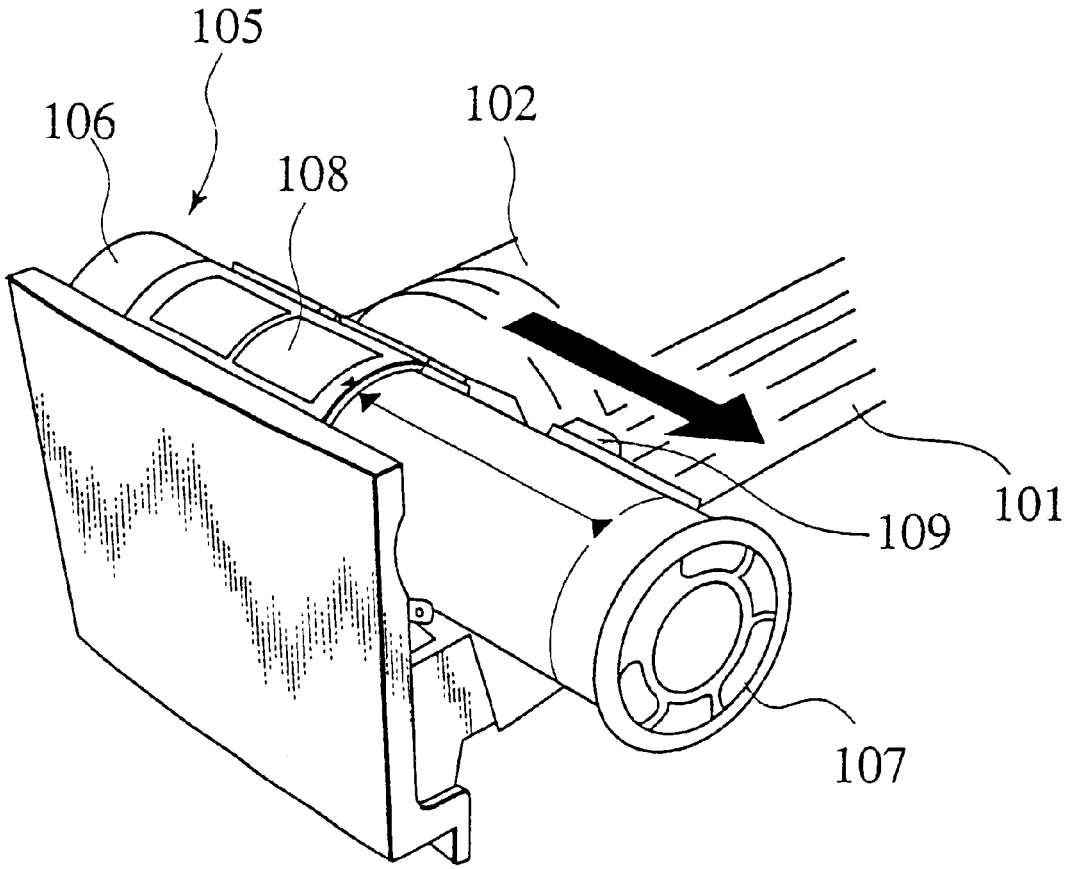
FIG.3 (PRIOR ART)
FIG. 3 is a perspective view of the printing machine of FIG. 2, showing the ink bottle set-up unit located in the retracted position with an ink bottle being pulled out from a bottle guide.
Figure 4:
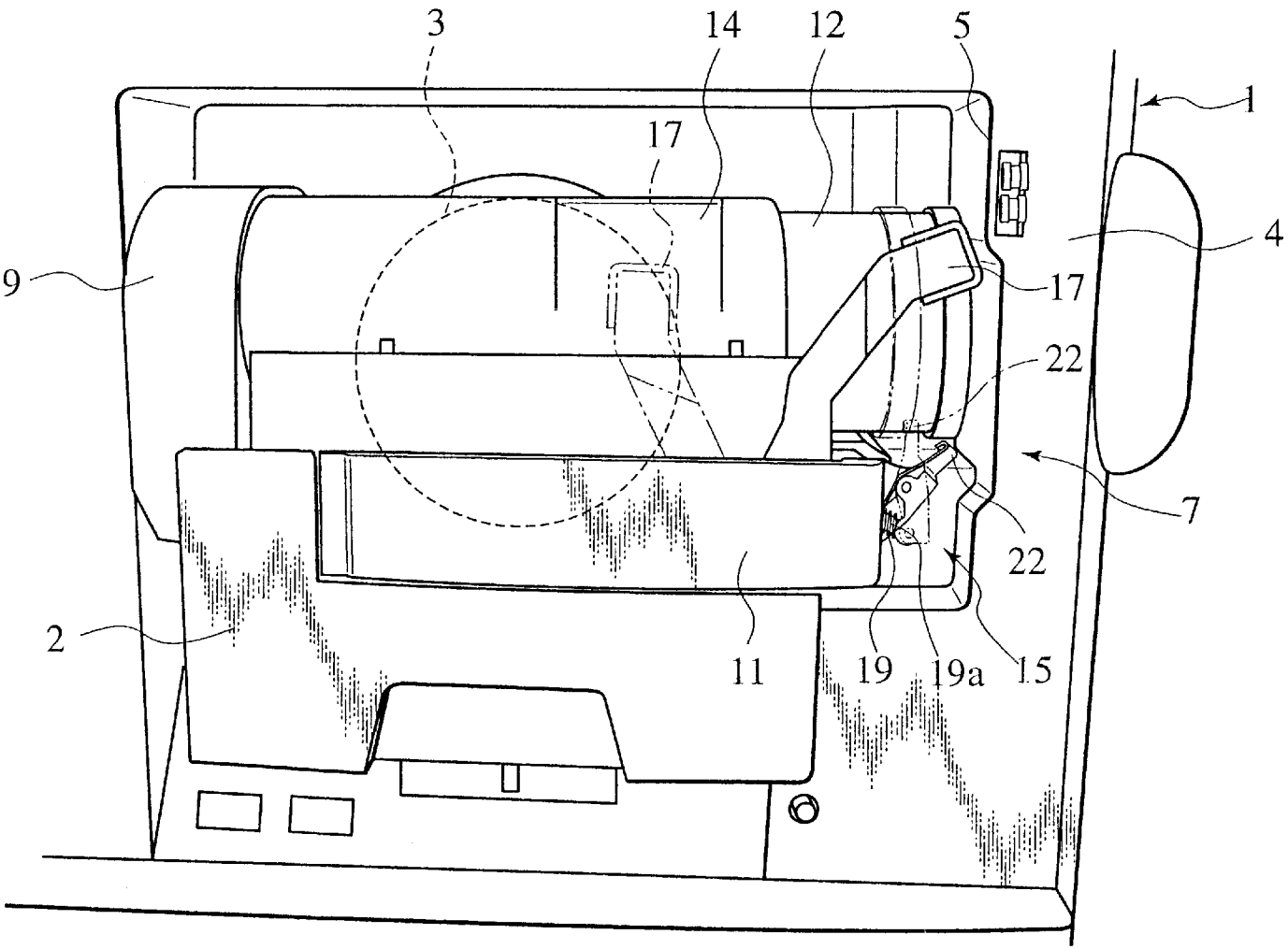
FIG. 4 is an exploded perspective view of a preferred embodiment of a printing machine according to the present invention, showing a turn table of an ink bottle set-up unit in a bottle receiving position.
Figure 5:
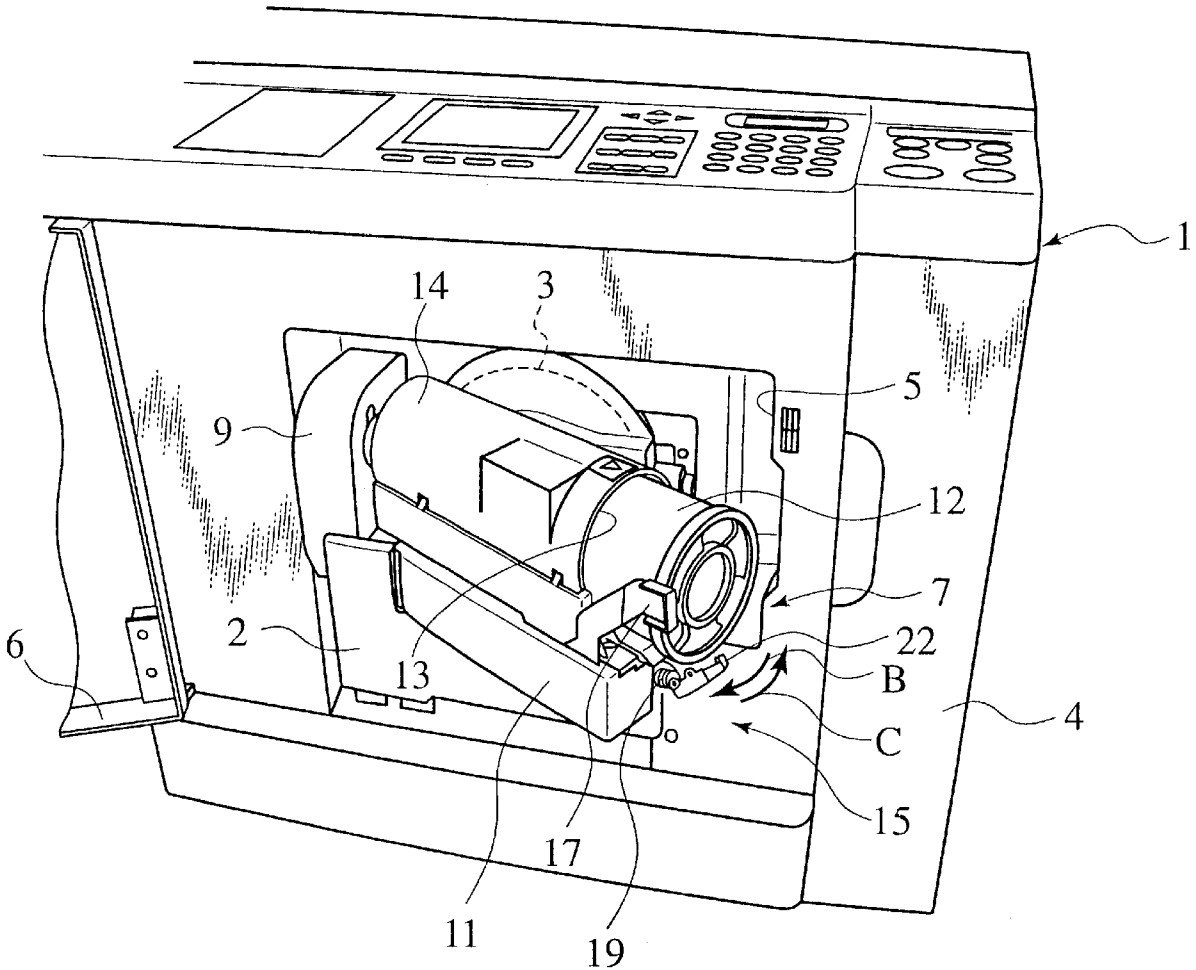
FIG. 5 is a perspective view of the preferred embodiment of the printing machine, showing the turn table of the ink bottle set-up unit in a bottle exchange position.
Figure 6:
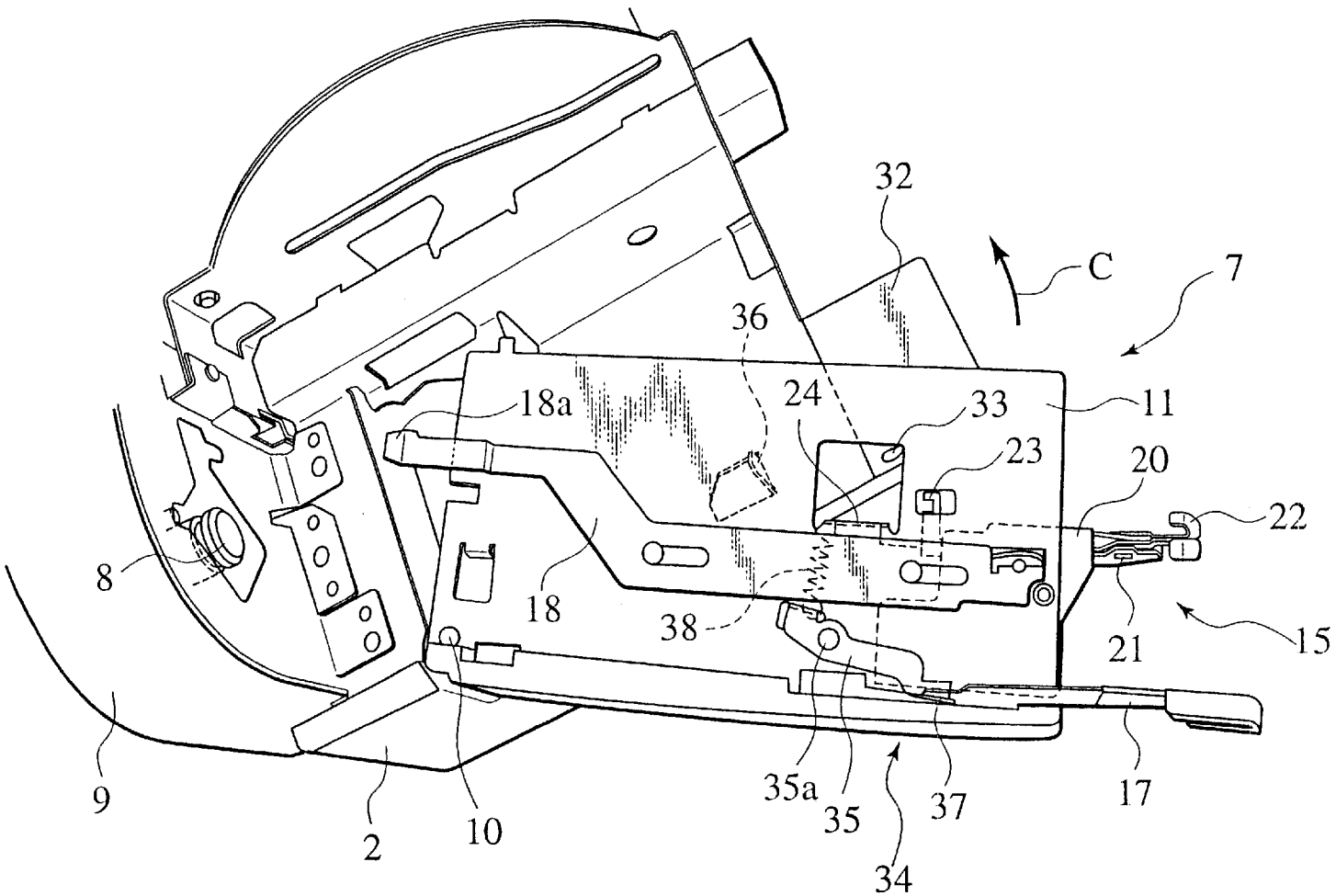
FIG. 6 is a perspective view of the ink bottle set-up unit of the printing machine according to the present invention, with the bottle guide being cut away for clarity, showing the turn table in the bottle exchange position.

Referring now to FIGS. 4 and 5, there is shown a preferred embodiment of a printing machine according to the present invention. In FIGS. 4 and 5, the printing machine includes a body 1 in which a drum support member 2 carrying thereon a drum 3 is moveably supported for sliding movement between a printing position in which the drum is inside the body 1 and an inoperative position in which the drum 3 is held outside the body 1. An outer periphery of the body 1 is covered with a body case 4, which has an opening 5. The opening 5 is closed or opened with a cover door 6 (see FIG. 5). When the cover door 6 is opened, the drum support member 2 carrying thereon the drum 3 can be freely inserted into or pulled out from the body 1. Under a condition in which the drum 3 is held in the body 1, an ink bottle set-up unit 7 is located in an internal space between a front distal end of the drum 3 and the opening 5 of the body case 4. The ink bottle set-up unit 7 is moveably supported on the drum support member 2 for rotating movement independently therefrom.

As shown in FIGS. 6 to 10 in detail, the ink bottle set-up device 7 includes a head section 9 fixed to the drum support member 2 and having an ink receptor port 8, and a turn table 11 supported on and freely rotatable on the drum support member 3 via a pivot shaft 10. A bottle guide 14 having a bottle set-up chamber 13 formed therein is mounted on the turn table 11 to allow set-up of an ink bottle 12. Owing to rotating movement of the turn table 11, the turn table 11 can be freely rotated between a bottle exchanger position (see FIG. 5) in which the ink bottle 12 is allowed to be inserted into the bottle set-up chamber 13 through the opening 5 from outside of the body 1, and a bottle receiving position (see FIG. 4) in which the ink bottle 12 that has been inserted into the bottle set-up chamber 13 is accommodated in the internal space within the opening 5. When the turn table 11 is moved to the bottle receiving position, the ink bottle 12 received in the bottle set-up chamber 13 is suitably fitted to the ink receptor port 8. At the bottle receiving position, also, the ink bottle 12 is placed sideward and close to the drum 3.

An ink bottle coupling means 15 includes an actuating lever 17 supported on a pivot shaft 16 fixed to the turn table 11, a slide plate 18 connected to the actuating lever 17 via a connecting pin **18*b* to slide on the turn table 11 following rotating motion of the actuating lever 17, a link member 19 having its one end connected to the actuating lever 17 for free rotating movement and connected at the other end to a bottle urging member 22 for free rotating movement, a compression coil spring 19*a* through which the link member 19 extends and which has its one end connected to the link member 19 and the other end connected to the bottle urging member 22, and the bottle urging member 22 rotatably supported on a bracket 20 via a support pin 21. The slide plate 18 has a distal end formed with an upwardly extending bottle stopper projection 18*a* at a position near the ink receptor port 8**.

Also, the bottle urging member 22 has an elongated slot to which the link member 19 is connected. The link member 19 is connected to the bottle urging member 22 with a few play. Since, however, the bottle urging member 22 is urged by the coil spring **19*a* in a direction away from the link member 19, the link member 19 and the bottle urging member 22 are connected to one another without the play. With such a structure, the bottle urging member 22 is rotated about the support pin 21 against the force of the compression coil spring 19*a***, thereby allowing dimensional variations of the ink bottle caused by swelling.

Under circumstances where a front distal end of the ink bottle 12 received in the bottle set-up chamber 13 is moved to a position to abut against the bottle stopper projection **18*a*, viz., a bottle uncoupling position (see FIGS. 9 and 10), when the actuating lever 17 is rotated counter-clockwise, the slide plate 18 is caused to slide closer to the ink receptor port 8 while releasing the bottle stopper action of the ink bottle 12. In this event, the bottle urging member 22 is rotated counter-clockwise such that a rear end of the ink bottle 12 is pressed to move the ink bottle 12 toward the ink receptor port 8 until an ink discharge port 12*a* of the ink bottle 12 is moved to a bottle coupling position (see FIGS. 7 and 8) in which the ink discharge port 12*a* is coupled to the ink receptor port 8**.

On the contrary, under the circumstances where the ink bottle 12 is moved to the bottle coupling position (see FIGS. 7 and 8), if the actuating lever 17 is rotated clockwise, the bottle urging member 22 is rotated clockwise, thereby releasing the rear end of the ink bottle 12. In this event, the slide plate 18 is moved in sliding motion in a direction away from the ink receptor port 8 to press the front distal end of the ink bottle 12 such that the ink bottle 12 is moved away from the ink receptor port 8 toward the bottle uncoupling position (see FIGS. 9 and 10) in which the ink receptor port 8 is separated from the ink discharge port **12*a* of the ink bottle 12**.

Since, further, a toggle spring 25 is connected between a spring engagement segment 23 of the actuating lever 17 and a spring engagement segment 24 of the turn table 11, the actuating lever 17 is held in the bottle uncoupling position when it is located at that position and is also held in the coupling position when it is located at that position.

A first ink receptor protecting means 30 includes an engaging segment 31 that extends from a lower end of the actuating lever 17, and an elongated engagement slot 33 formed in the bracket 32 fixed to the drum support member 2. When the actuating lever 17 remains in a position in which the ink bottle 12 is located in the bottle uncoupling position, the engaging segment 31 is displaced upward from the engagement slot 33, permitting the turn table 11 to move from the bottle receiving position to the bottle exchange position. In contrast, when the actuating lever 17 remains in a position in which the ink bottle 12 is located in the bottle coupling position, the engaging segment 31 is brought into engagement with the elongated engagement slot 33, thereby preventing the turn table 11 to move from the bottle receiving position to the bottle exchange position.

A second ink receptor port protecting means 34 includes a lever lock member 35 connected to the turn table 11 via a support pin 35*a* for free rotating movement, and a lock release member 36 fixed to the drum support member 2 at a location above a rotating trajectory of a distal end of the lever lock member 35 when the turn table 11 is located at the bottle receiving position. The lever lock member 35 is rotatable between a rotation stopper position in which the lever lock member 35 is aligned on the rotating trajectory of a projecting segment 37 of the actuating lever 17 and a rotation allowable position in which the projecting segment 37 of the actuating lever 17 is out of alignment with the rotating trajectory of the projecting segment 37 of the actuating lever 17, with a tension spring 38 urging the lever lock member 35 toward the rotation stopper position. In addition, under the circumstances where the turn table 11 remains at the bottle receiving position, the lever lock member 35 is located at the rotation allowable position by the lock releasing member 36 against the force of the tension coil spring 38. Under the circumstances where the turn table 11 remain at the bottle exchange position, the lever lock member 35 is located at the rotation stopper position by the force of the tension coil spring 38, thereby preventing the bottle coupling means 15 to move between the bottle coupling position and the bottle non-coupling position.

Figure 7:
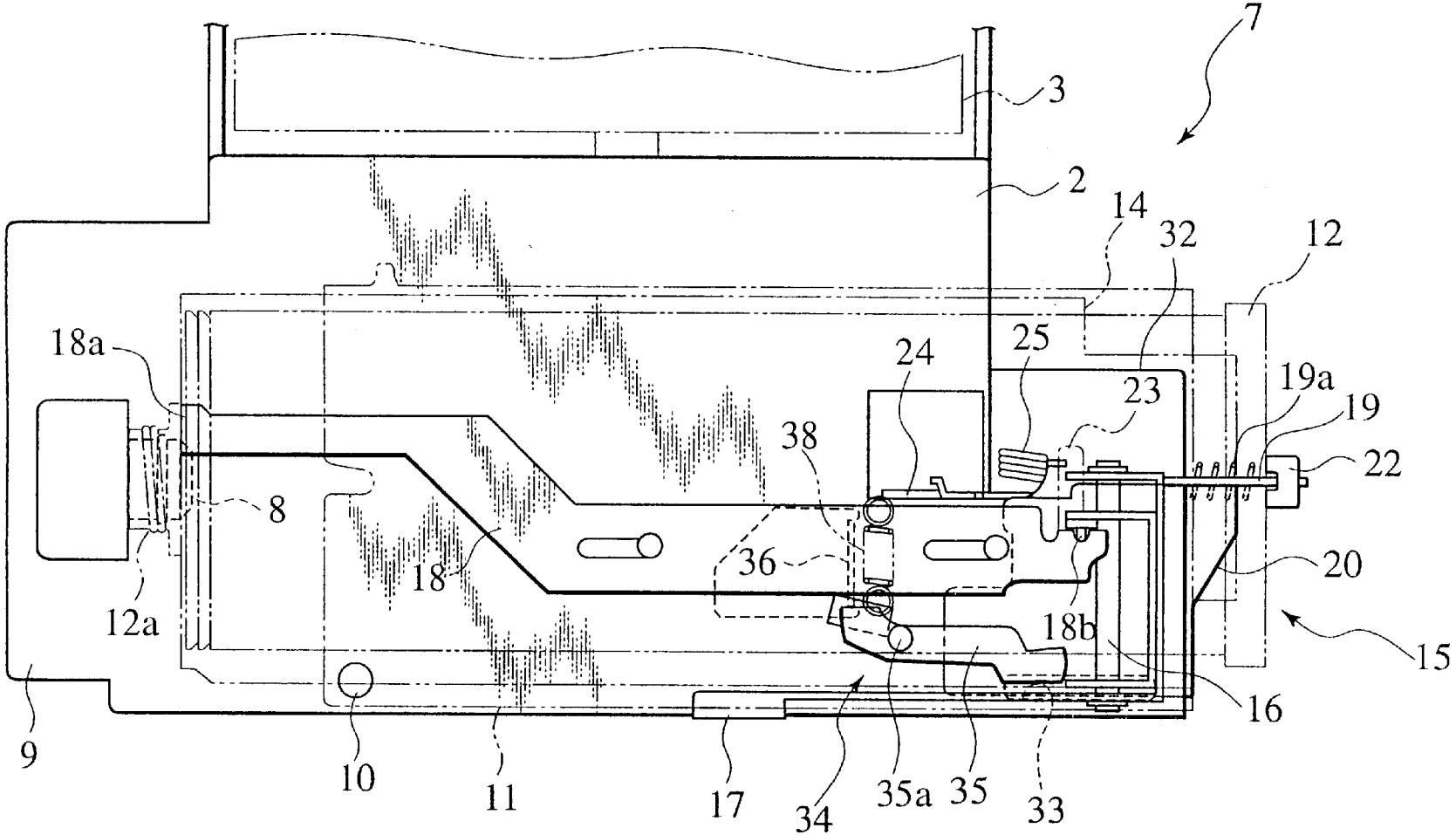
FIG. 7 is a plan view of the ink bottle set-up unit of the printing machine according to the present invention, showing the turn table in a bottle receiving position and the ink bottle located in a bottle coupling position.

Now, the operation for an exchange work of the ink bottle 12 in the ink bottle set-up unit 7 will be described. Before replacing the ink bottle 12, the ink bottle set-up unit 7 is located under a condition where an ink can be supplied and, as shown in FIGS. 7 and 8, the turn table 11 is located in the bottle receiving position while the ink bottle 12 is located in the bottle coupling position.

Figure 8:
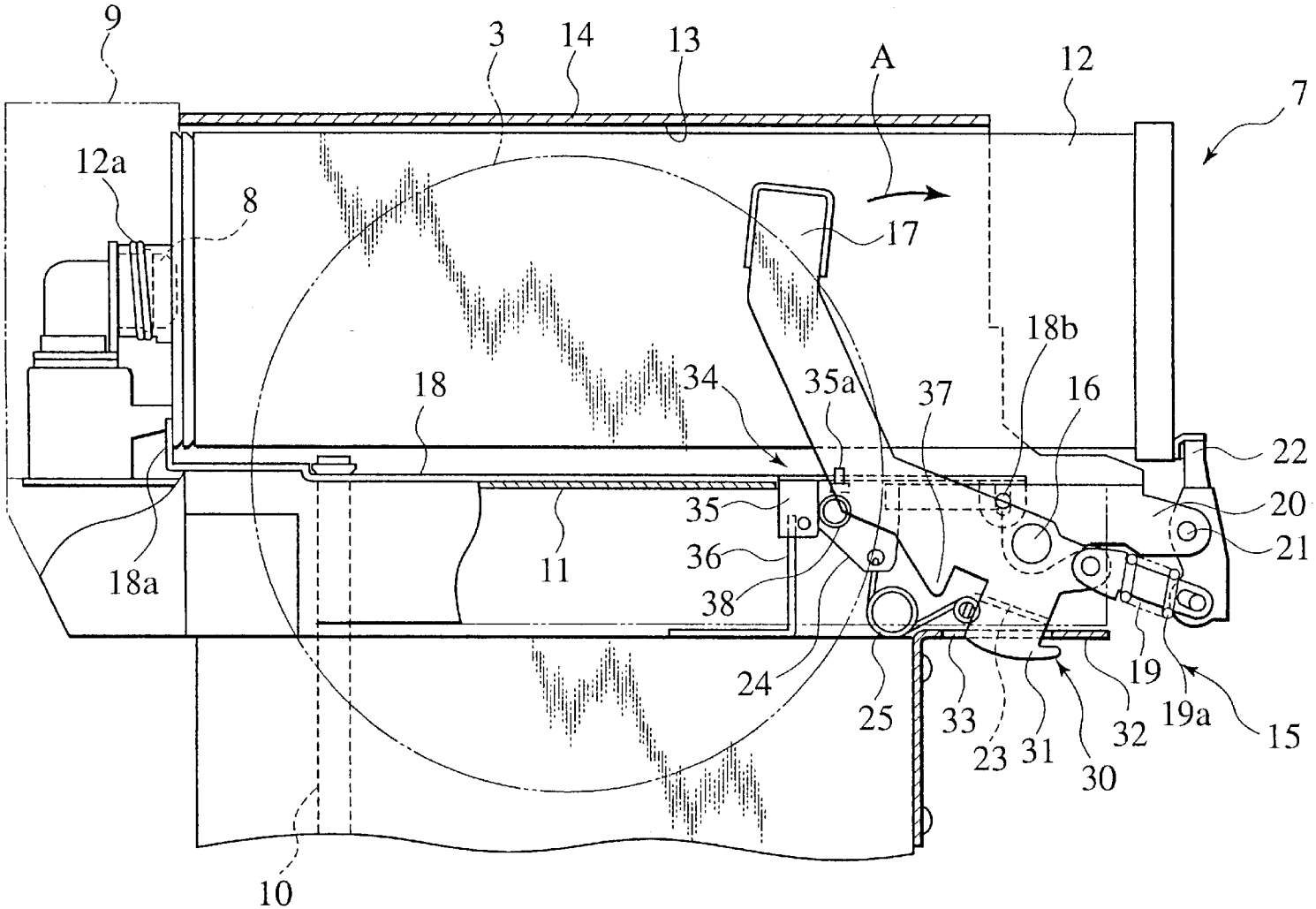
FIG. 8 is a side view, partly cut away for clarity, of the ink bottle set-up unit of he printing machine according to the present invention, showing the turn table in the bottle receiving position and the ink bottle located in the bottle coupling position.
Figure 9:
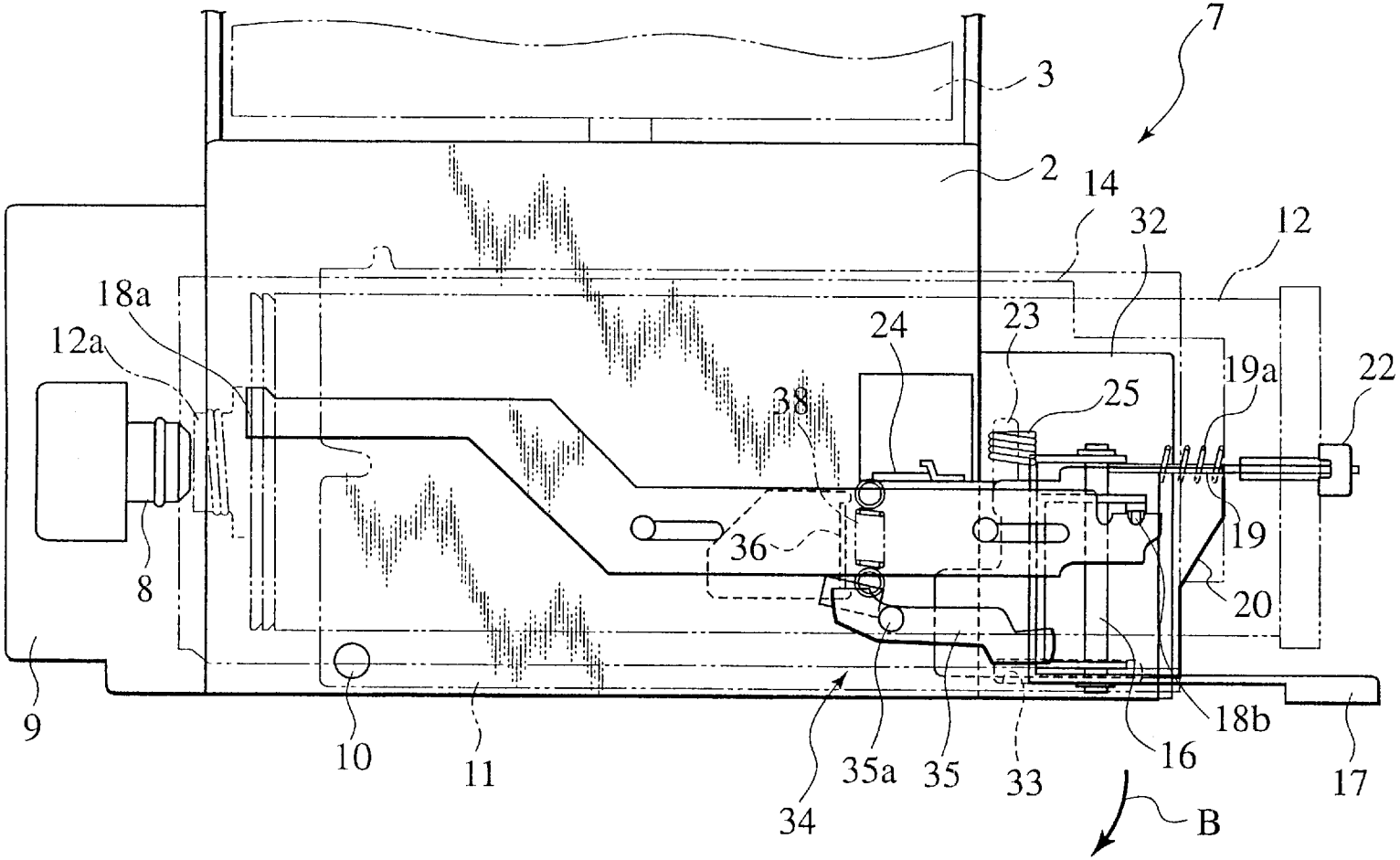
FIG. 9 is a plan view of the ink bottle set-up unit of the printing machine according to the present invention, showing the turn table in the bottle receiving position and the ink bottle in the bottle uncoupling position.
Figure 10:
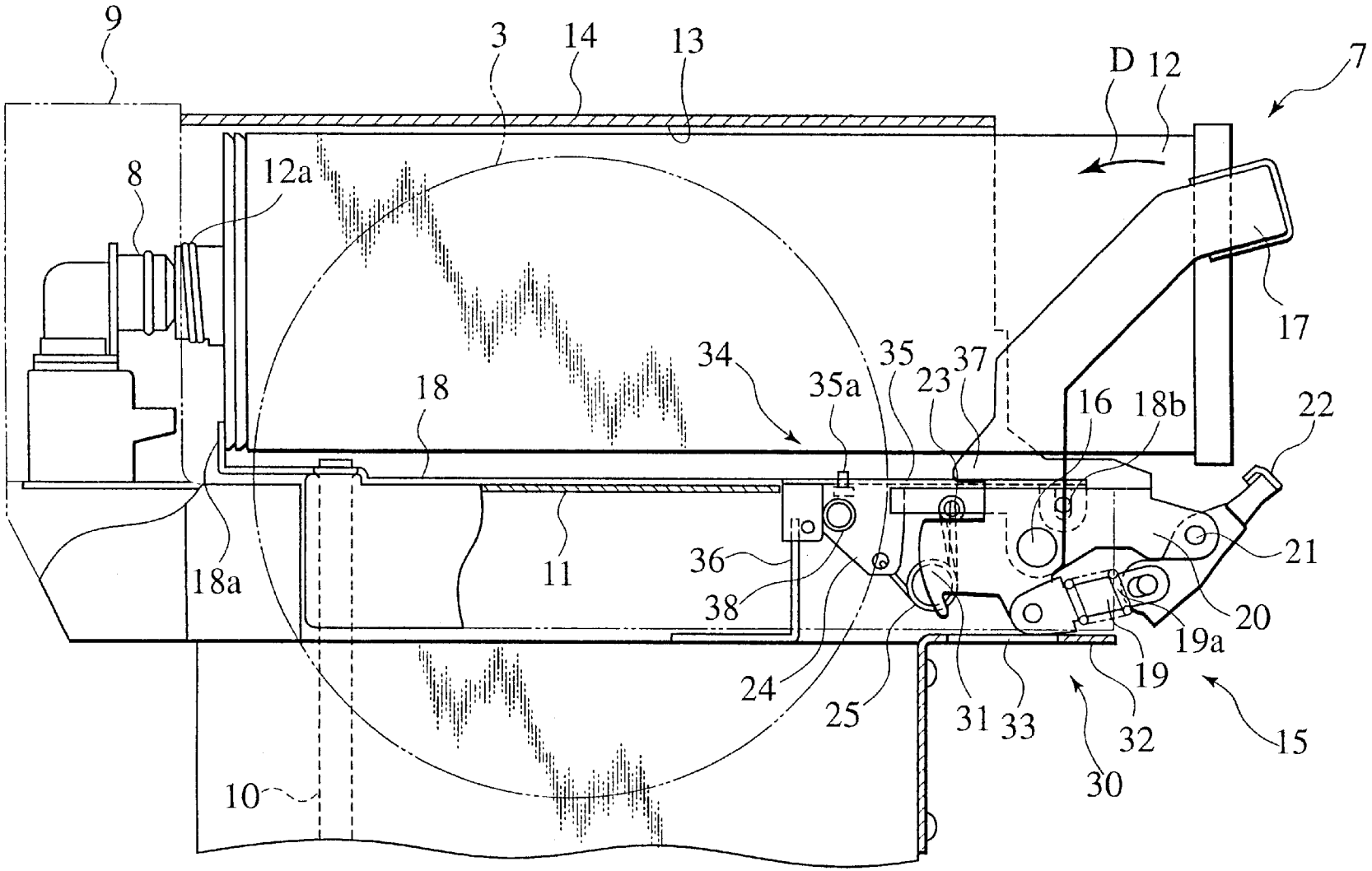
FIG. 10 is a side view, partly cut away, of the ink bottle set-up unit of the printing machine according to the present invention, showing the turn table in the bottle receiving position and the ink bottle in the bottle uncoupling position.

Initially, the cover door 6 is opened and the actuating lever 17 is rotated clockwise as shown by an arrow A in FIG. 8, thereby moving the ink bottle 12 from the bottle coupling position to the bottle uncoupling position (see FIGS. 9 and 10). Next, the turn table 11 is rotated clockwise in a direction as shown by an arrow B in FIGS. 5 and 9, thereby moving the turn table 11 from the bottle receiving position to the bottle exchange position (see FIG. 5). At the bottle exchange position, the ink bottle 12 is pulled out from the bottle setup chamber 13 and replaced with a new ink bottle 12. In this event, since the front distal end of the ink bottle 12 is restricted for its movement by the bottle stopper projection 18*a* of the slide plate 18, the ink bottle 12 is moved only to the bottle coupling position. Subsequently, the turn table 11 is rotated counterclockwise in a direction as shown by an arrow C in FIGS. 5 and 6 such that it is moved from the bottle exchange position to the bottle receiving position (see FIGS. 9 and 10). At the bottle receiving position, the actuating lever 17 is rotated counter-clockwise in a direction as shown by an arrow D in FIG. 10, thereby moving the ink bottle 12 from the bottle uncoupling position to the bottle coupling position to complete the bottle replacement work cycle (as shown in FIGS. 7 and 8).

Note should be undertaken that, when it is required to take out the drum 3 from the body 1 of the printing machine with a view to repairing or replacing the drum, the drum support member 2 may be horizontally pulled out from the opening 5 to remove the drum 3 from the drum support member 2.

While, in the illustrated embodiment, there exist a limitation in the rotational angle in which the ink bottle 12 can be replaced with a new one from the opening 5 at the bottle exchange position, it should be noted that it is possible to freely design the rotational direction or rotational angle of the bottle receiving position relative to the drum 3 to provide a desired compact structure for the printing machine. In the illustrated embodiment discussed above, a cylindrical periphery of the ink bottle 12 is located sideward and close to the drum 3, and replacement of the ink bottle 12 may be performed in the same manner as that of the conventional printing machine except for rotating the turn table 11 in which the ink bottle 12 is set up without pulling out a heavy drum 3. It will thus be understood that it becomes possible for the ink bottle 12 to be easily replaced with the new one without pulling out the drum 3 to prevent the printing machine from being largely sized.

In the illustrated embodiment wherein the ink receptor port 8 is fixed stationary relative to the drum support member 2, further, in order to replace the ink bottle 12 with new one, it is required to rotate the turn table 11 to the bottle exchange position after moving the ink bottle 12 from the bottle coupling position to the bottle uncoupling position, to replace the ink bottle 12 with new one, and to rotate the turn table 11 to the bottle receiving position and subsequently rotate the ink bottle 12 from the bottle uncoupling position to the bottle coupling position. To this end, at the bottle receiving position of the turn table 11, the bottle coupling means 15 makes it possible to carry out coupling or uncoupling operation of the ink bottle 12 and, therefore, it becomes possible to carry out coupling or uncoupling operation of the ink bottle 12 toward or away from the ink receptor 8 in a suitable direction. Consequently, in a case where the ink receptor port 8 is fixed stationary, it is possible to prevent the ink bottle 12 or the ink receptor port 8 from being subjected to excessive external force to avoid troubles such as undesirable rupturing or damages of the ink bottle.

In the illustrated embodiment, in a case where the ink bottle 12 is located in the non-coupling position, the turn table 11 is enabled to move from the bottle receiving position to the bottle exchange position such that, when the ink bottle 12 is located in the bottle coupling position, the first ink receptor protecting means 30 serves to prevent the turn table 11 from being rotated from the bottle receiving position to the bottle exchange position, thereby preventing the turn table 11 and the ink bottle 12 from being rotated when the ink bottle 12 is coupled to the ink receptor port 8 to prevent the ink receptor port 8 and the ink bottle 12 from being subjected to excessive external force to avoid troubles such as rupturing or damages of the ink bottle.

In the illustrated embodiment, in a case where the turn table 11 is located in the bottle receiving position, the bottle coupling means 15 enables to move between the bottle uncoupling position and the bottle coupling position such that, when the turn table 11 is located in the bottle exchange position, the second ink receptor protecting means 34 serves to prevent the bottle coupling means 15 from being moved between the bottle uncoupling position and the bottle coupling position, when the turn table 11 is held in the bottle exchange position, that is, when the ink bottle 12 is coupled to the ink receptor port 8 in an unsuitable coupling direction, the ink bottle 12 is prevented from being coupled to the ink receptor port 8, thereby preventing the ink receptor port 8 or the ink bottle 12 from being subjected to excessive external force to avoid troubles such as rupturing or damages of the ink bottle.

In the illustrated embodiment, further, since the ink bottle 12 is held in the bottle coupling position with the action of the bottle urging means 22 via the link member 19 and is urged with the compression coil spring 19*a*, it is possible to urge the ink bottle 12 toward the bottle coupling position with suitable spring force even in a case where the ink bottle 12 is subjected to variations in size caused by swelling etc.

In the illustrated embodiment, also, although the first ink receptor protecting means 30 has been shown and described as including the engaging segment 31 extending from the actuating lever 17 and the engaging slot 33 formed in the drum support member 2, the first ink receptor protecting means may have a structure wherein, when the ink bottle 12 is held in the bottle uncoupling position, the turn table 11 can be moved between the bottle receiving position and the bottle exchange position and, when the ink bottle 12 is held in the bottle coupling position, the turn table 11 is prevented from being moved between the bottle receiving position and the bottle exchanger position.

In the illustrated embodiment, also, although the second ink receptor protecting means 34 has been shown and described as including the lever lock member 35 rotatably mounted on the turn table 11, the tension coil spring 38 for urging the lever lock member 35 and the lock releasing member 36 fixedly secured to the drum support member 2, the second ink receptor protecting means 34 may have a structure wherein, when the turn table 11 is held in the bottle receiving position, the turn table 11 can be moved between the bottle uncoupling position to the bottle coupling position by the bottle coupling means 15 and, when the turn table 11 is held in the bottle exchange position, the turn table 11 is prevented from being moved between the bottle uncoupling position and the bottle coupling position by the bottle coupling means 15.

While, in the illustrated embodiment discussed above, the printing machine has been shown and described as applied to the stencil printing machine, the present invention may also be applied to other types of printing machines.

It will now be appreciated from the foregoing description that, according to one feature of the present invention, the ink bottle can be replaced with new one by rotating the turn table from the bottle receiving position to the bottle exchange position, pulling out the ink bottle from the bottle set-up chamber at the bottle exchange position, inserting a new ink bottle into the bottle set-up chamber and rotating the turn table from the bottle exchange position to the bottle receiving position. In this event, although there exists a limitation in a rotatable range wherein the ink bottle can be replaced through the opening at the ink bottle exchange position, there is no limitation in a rotational direction of the bottle receiving position relative to the drum and it is possible to freely design the rotational direction such that the printing machine may have a compact structure which is not largely sized, with a resultant ease of replacement of the ink bottle without pulling out the heavy bottle.

Further, since the ink bottle can be replaced in a space where the drum is pulled out, it is not required to newly provide an exchange space for the ink bottle in a peripheral area of the printing machine. Accordingly, the printing machine can be installed in a reduced occupying space.

According to another feature of the present invention, although the ink receptor port is fixed stationary relative to the drum support member, it is required that the ink bottle may be replaced with new one by moving the ink bottle from the coupling position to the non-coupling position and subsequently rotating the turn table to the bottle exchange position, replacing the ink bottle with the new one, rotating the turn table to the bottle receiving position and subsequently positioning the ink bottle from the non-coupling position to the bottle coupling position. In this event, when the turn table is held in the bottle receiving position, it is possible for the bottle coupling means to achieve coupling or uncoupling the ink bottle to allow the ink bottle to be coupled in a suitable direction to the ink receptor port or to be uncoupled, thereby preventing the ink receptor port or the ink bottle from being subjected to excessive external force to avoid troubles such as rupturing or damages of the ink bottle.

According to a further feature of the present invention, since, when the ink bottle 12 is held in coupling state with the ink receptor port, the turn table and the ink bottle can not be rotated, it is possible to prevent the ink receptor port or the ink bottle from being subjected to excessive external force to void troubles such as rupturing or damages of the ink bottle.

According to a still further feature of the present invention, since, when the turn table is held in the bottle exchange position, that is, when the ink bottle is coupled to the ink receptor port in an unsuitable coupling direction, the ink bottle is prevented from being coupled to the ink receptor port, thereby preventing the ink receptor port or the ink bottle from being subjected to excessive external force to avoid troubles such as rupturing or damages of the ink bottle.

The foregoing description of the preferred embodiments of the invention has been presented to illustrate the principles of the invention and not to limit the invention to the particular embodiments illustrated. It is intended that the scope of the invention defined by all of the embodiments encompassed within the following claims, and equivalents thereof.

What is claimed is:

1. An ink bottle set-up unit for a printing machine having a body formed with an opening, comprising:

a moveable drum support member carrying thereon a drum, with the drum support member and the drum being allowed to be inserted into or pulled out from the body;

a turn table rotatably mounted on the drum support member; and a bottle guide located on the turn table and having a bottle set-up chamber to receive an ink bottle;

wherein the turn table is freely rotatable between a bottle exchange position in which the ink bottle is allowed to be inserted into the bottle set-up chamber through the opening of the body, and a bottle receiving position in which the ink bottle set up in the bottle set-up chamber is received in a space.

2. An ink bottle set-up unit for a printing machine having a body formed with an opening according to claim 1, wherein the drum support member has an ink receptor port to which, when the turn table is held in the bottle receiving position, the ink bottle set up in the bottle set-up chamber is coupled in a given coupling direction, and further comprising bottle coupling means movable between a bottle upcoupling position to allow the ink bottle set up in the bottle set-up chamber to be separated from the ink receptor port and a bottle coupling position to allow the ink bottle to be coupled to the ink receptor port.

3. An ink bottle set-up unit for a printing machine having a body formed with an opening according to claim 2, further comprising first ink receptor protecting means for allowing the turn table to move from the bottle receiving position to the bottle exchange position when the ink bottle is held in the bottle uncoupling position and for preventing the turn table to move from the bottle receiving position to the bottle exchange position when the ink bottle is held in the bottle coupling position.

4. An ink bottle set-up unit for a printing machine having a body formed with an opening according to claim 3, further comprising second ink receptor protecting means for allowing the bottle coupling means to move between the bottle uncoupling position and the bottle coupling position when the turn table is held in the bottle receiving position and for preventing the bottle coupling means to move between the bottle uncoupling position and the bottle coupling position when the turn table is held in the bottle exchange position.

5. An ink bottle set-up unit for a printing machine having a body formed with an opening, comprising:

a drum support member carrying a drum thereon and moveably supported in the body for sliding movement through the opening between a printing position in which the drum is held inside the body and an inoperative position in which the drum is held outside the body; and an ink bottle set-up unit moveably supported on the drum support member and including a turn table rotatably mounted on the drum support member independently therefrom, a bottle guide supported on the turn table and having a bottle set-up chamber to receive an ink bottle, and ink bottle coupling means for enabling the turn table to move on the drum support member between a bottle exchange position in which the ink bottle is allowed to be inserted into the bottle set-up chamber, and a bottle receiving position in which the ink bottle is located in a set-up position to allow an ink to be supplied to the drum for printing.

* * * * *